US010018010B2

(12) United States Patent
King et al.

(10) Patent No.: US 10,018,010 B2
(45) Date of Patent: Jul. 10, 2018

(54) DISINTEGRATING AGGLOMERATED SAND FRACK PLUG

(71) Applicant: Baker Hughes Incorporated, Houston, TX (US)

(72) Inventors: James G. King, Kingwood, TX (US); James C. Doane, Friendswood, TX (US); Jason M. Harper, Cypress, TX (US); Robert J. Taylor, Houston, TX (US); Erwin D. Hernaez, Cypress, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 638 days.

(21) Appl. No.: 14/163,732

(22) Filed: Jan. 24, 2014

(65) Prior Publication Data

US 2015/0211324 A1 Jul. 30, 2015

(51) Int. Cl.

| | |
|---|---|
| ***E21B 33/12*** | (2006.01) |
| ***E21B 33/13*** | (2006.01) |
| ***E21B 43/14*** | (2006.01) |
| ***E21B 43/26*** | (2006.01) |

(52) U.S. Cl.
CPC ..... *E21B 33/1208* (2013.01); *E21B 33/13* (2013.01); *E21B 43/14* (2013.01); *E21B 43/26* (2013.01)

(58) Field of Classification Search
CPC ..... E21B 43/26; E21B 43/14; E21B 33/13
See application file for complete search history.

(56) References Cited

U.S. PATENT DOCUMENTS

| | | | | |
|---|---|---|---|---|
| 2,033,564 | A * | 3/1936 | Wells | E21B 33/12 166/130 |
| 2,758,818 | A * | 8/1956 | Kammerer, Jr. | E21B 17/1085 166/242.1 |
| 3,422,897 | A * | 1/1969 | Conrad | E21B 23/04 166/122 |
| 5,425,424 | A | 6/1995 | Reinhardt et al. | |
| 5,479,986 | A | 1/1996 | Gano et al. | |
| 5,607,017 | A | 3/1997 | Owens et al. | |
| 5,765,641 | A * | 6/1998 | Shy | E21B 23/00 166/192 |
| 6,026,903 | A | 2/2000 | Shy et al. | |
| 6,145,593 | A | 11/2000 | Hennig | |
| 6,220,350 | B1 * | 4/2001 | Brothers | E21B 33/12 166/192 |

(Continued)

*Primary Examiner* — Cathleen R Hutchins
*Assistant Examiner* — Ronald R Runyan
(74) *Attorney, Agent, or Firm* — Steve Rosenblatt

(57) ABSTRACT

The frack plug has a sealing element that reforms when set to hold differential pressure. The element is granular with adhesive to hold the granular particles together but allow the shape to reform under setting force. The adhesive can be broken down with a chemical agent or in other ways to allow the seal to reform to the sealing position at the desired depth. As a result the structural components can disintegrate and the seal assembly can fragment into small pieces that can be circulated out of the well or allowed to drop to the hole bottom. The seal can have particles of controlled electrolytic materials (CEM), natural or synthetic sand, swelling or non-swelling rubber. The assembly can contain pellets that selectively release to initiate the breakdown of the structural components of the frack plug.

39 Claims, 5 Drawing Sheets

(56) References Cited

U.S. PATENT DOCUMENTS 6,568,470 B2 5/2003 Goodson, Jr. et al.
6,926,089 B2 8/2005 Goodson et al.
7,093,664 B2 8/2006 Todd et al.
7,168,494 B2 1/2007 Starr et al.
7,353,879 B2 4/2008 Todd et al.
7,464,764 B2 * 12/2008 Xu ..... E21B 34/14 166/317
7,533,721 B2 5/2009 Sorhus
7,631,695 B2 * 12/2009 Schafer ..... E21B 33/1208 166/135
7,661,470 B2 2/2010 Doane et al.
7,673,692 B2 3/2010 Kunz et al.
7,958,940 B2 6/2011 Jameson
7,997,337 B2 8/2011 Kunz
8,056,638 B2 11/2011 Clayton et al.
8,151,895 B1 4/2012 Kunz
8,235,102 B1 8/2012 Robertson
8,256,521 B2 9/2012 Swor et al.
8,272,446 B2 9/2012 Swor et al.
8,291,969 B2 10/2012 Swor et al.
8,322,449 B2 12/2012 Clayton et al.
8,327,926 B2 12/2012 Robertson
2007/0277979 A1 * 12/2007 Todd ..... E21B 33/12 166/287
2008/0061510 A1 3/2008 Li et al.
2008/0200352 A1 8/2008 Willberg et al.
2009/0065191 A1 3/2009 Reid et al.
2011/0136707 A1 6/2011 Xu et al.
2012/0152524 A1 6/2012 Myers et al.
2012/0292014 A1 11/2012 Bishop
2012/0318513 A1 12/2012 Mazyar et al.
2013/0000914 A1 1/2013 Kelbie et al.
2013/0043041 A1 * 2/2013 McCoy ..... E21B 34/063 166/373
2013/0206425 A1 8/2013 Mazyar et al.
2013/0248194 A1 9/2013 Huang
2014/0014339 A1 1/2014 O'Malley et al.
2014/0048251 A1 * 2/2014 King ..... E21B 33/1285 166/120
2014/0110102 A1 * 4/2014 Hall ..... E21B 27/00 166/244.1
2014/0110112 A1 * 4/2014 Jordan, Jr. ..... E21B 33/1293 166/281

* cited by examiner

DISINTEGRATING AGGLOMERATED SAND FRACK PLUG

FIELD OF THE INVENTION

The field of the invention is frack plugs that isolate treated zones so that additional zones can be perforated and fracked, and more particularly plugs that can be removed without drilling, or other intervention, so that the well can be rapidly put into production.

BACKGROUND OF THE INVENTION

Fracking operations typically involve setting an isolation device and perforating and fracking above the set device. This process is repeated as the producing zone is perforated and fractured in a bottom up direction. At the conclusion of the perforating and fracturing of the producing zone the plugs need to be removed so that production can begin. Milling out what could be dozens of plugs can be very time consuming and thus expensive because production is delayed and the debris that is generated in the milling operation needs to be removed either with circulation or with capture devices to collect the debris.

To aid the milling process the plugs can be made of non-metallic or composite materials. While this technique is workable, there was still a lot of time spent to mill out even the softer bridge plugs and remove that milling debris from the wellbore.

In the past there have been plugs used that are milled out as described in U.S. Pat. No. 7,533,721. Some are forcibly broken to open a passage such as in U.S. Pat. No. 6,026,903. Other designs created a plug with material that responded to a magnetic field as the field was applied and removed when the field was removed. This design was described in U.S. Pat. Nos. 6,926,089 and 6,568,470. In a multi-lateral application a plug was dissolved from within the whipstock to reopen the main bore after the lateral was completed. This is described in U.S. Pat. No. 6,145,593. Barriers that assist in extending telescoping passages and then are removed for access to fracture the formation are described in U.S. Pat. No. 5,425,424. Longitudinally extending radially expanded packers to get them to release is shown in U.S. Pat. No. 7,661,470.

In a variation of the above designs US Publication 2013/0000914 discusses a thin wall mandrel that is then expanded to enlarge the passage through the mandrel as a way of increasing production after sequential fracturing is over. While this design addressed the need for a larger bore diameter for subsequent production, the design still had issues with collapse resistance when the packer was set and the pressures used in fracturing were applied to the annular space causing an excessive compressive collapse force on the frack packer mandrel.

More recently a design to temporarily support a shear component in a shear plane has been described by William Hered and Jason Barnard in an application called Reinforced Shear Components and Methods of Using Same. Here a disc was interposed in the shear plane and retained in position against a bias force. At a predetermined time the bias force was allowed to move the disc out of the shear plane so that the structure was weakened in the shear plane and the desired failure could occur in the shear plane to release two members to move relatively.

Another design seeks to address the need for compressive strength against external pressures that would otherwise cause a collapse while at the same time addressing the later need for a larger flow diameter for subsequent production where the fracking was done and there no longer was a need to hold back against compressive collapse forces from outside the mandrel. This is accomplished without a need for expansion. A tubular insert is made of structural tubular materials preferable controlled electrolytic materials or CEM. Controlled electrolytic materials have been described in US Publication 2011/0136707 and related applications filed the same day. The related applications are incorporated by reference herein as though fully set forth. After the packer is set in tension and subjected to fracturing forces it no longer needs high collapse resistance and the CEM sleeve is removed to make a larger flow diameter for subsequent production. Other applications are envisioned where a tubular structure responds to differing pressure conditions at different times in a service life. For example in the fracking situation the anticipated tensile load for production is about 30,000 to 50,000 pounds force and for fracturing can be orders of magnitude higher.

Various plug designs for subsequent removal by a variety of techniques are illustrated in the following U.S. Pat. Nos.: 5,607,017; 5,479,986; 7,093,664; 7,168,494; 7,353,879; 7,673,692; 7,958,940; 7,997,337; 8,151,895; 8,056,638; 8,235,102; 8,256,521; 8,272,446; 8,291,969; 8,322,449; 8,327,926; 2012/0152524; 2012/0318513; 2013/0206425; 2013/02481945.

Plug removal despite the use of composite components or components that dissolve can still lead to an incomplete removal of the plugs causing operational problems when going on production. Typically, plug design involving slips and a longitudinally compressed resilient seal such as rubber annular rings present such situations of incomplete removal. This is because the slips must withstand significant mechanical loads under the pressure differentials that are seen during the fracturing process. What is needed and provided by the present invention is a new design for the frack plugs where the structural body parts such as the mandrel can be made of readily disintegrating material such as CEM and the seal material is granular but with sufficient structural integrity for running in to the desired location and remaining structurally sound. However, when the desired location is reached the granular material is reconfigured, generally with axial compressive force to form a cohesive seal that can withstand the pressure differentials seen in the fracking process. The reconfiguration allows a reordering of the initial shape with sufficient residual binding for the granular material so that axial compression leaves much of the granular material cohesive to the point that on compression it stays together enough to be compressed into an impervious annular shape. The advantage lies in the speed of removal of such a plug without resorting to drilling. The body materials are disintegrated with fluids introduced into the borehole. Exposure to wellbore conditions or materials brought into the borehole also weakens the binder for the granular material such that the undermining of the structural components coupled with the weakening of the binder and the granular nature of the material acting as the seal allows for a rapid degradation of the seal material into a loose granular pieces that can be readily circulated out of the borehole or alternatively allowed to drop to the borehole bottom or a further downhole location, depending on the configuration of the borehole. Those skilled in the art will better appreciate these and other aspects of the present invention from the detailed description and the associated drawing s while recognizing that the full scope of the invention can be obtained from the appended claims.

SUMMARY OF THE INVENTION

The frack plug has a sealing element that reforms when set to hold differential pressure. The element is granular with adhesive to hold the granular particles together but allow the shape to reform under setting force. The adhesive can be broken down with a chemical agent or in other ways to allow the seal to reform to the sealing position at the desired depth. As a result the structural components can disintegrate and the seal assembly can fragment into small pieces that can be circulated out of the well or allowed to drop to the hole bottom. The seal can have particles of controlled electrolytic materials (CEM), natural or synthetic sand, swelling or non-swelling rubber. The assembly can contain pellets that selectively release to initiate the breakdown of the structural components of the frack plug.

DETAILED DESCRIPTION OF THE PREFERRED EMBODIMENT

Figure 1:
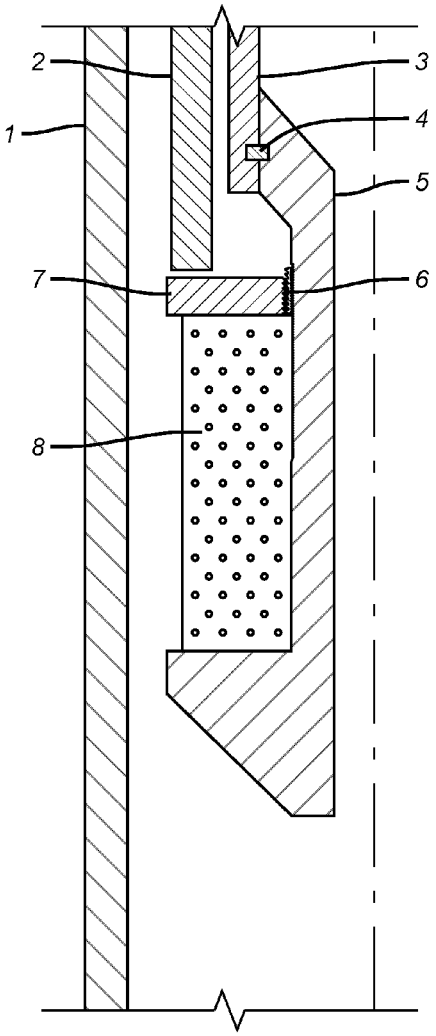
FIG. 1 is a section view of an embodiment of the present invention in half section and in the run in position.
Figure 2:
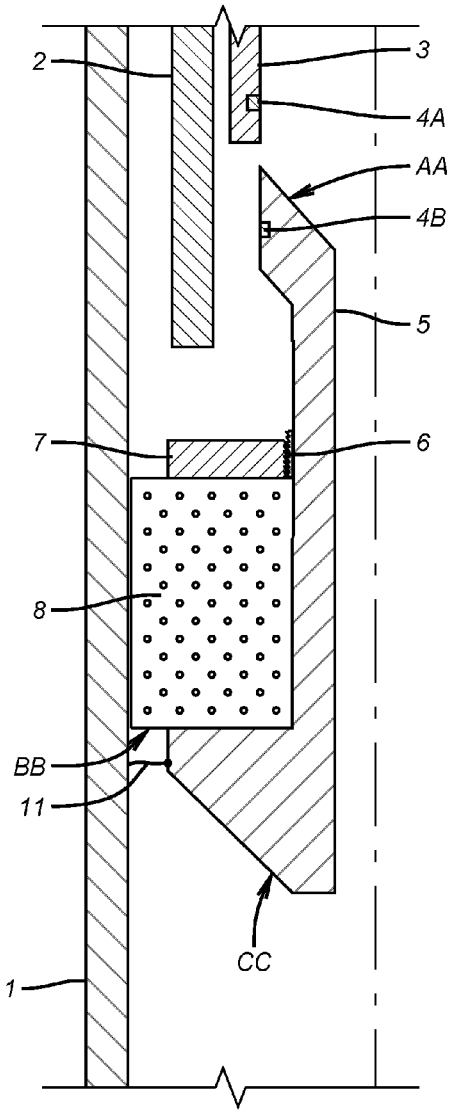
FIG. 2 is the view of FIG. 1 in the set position.
Figure 4:
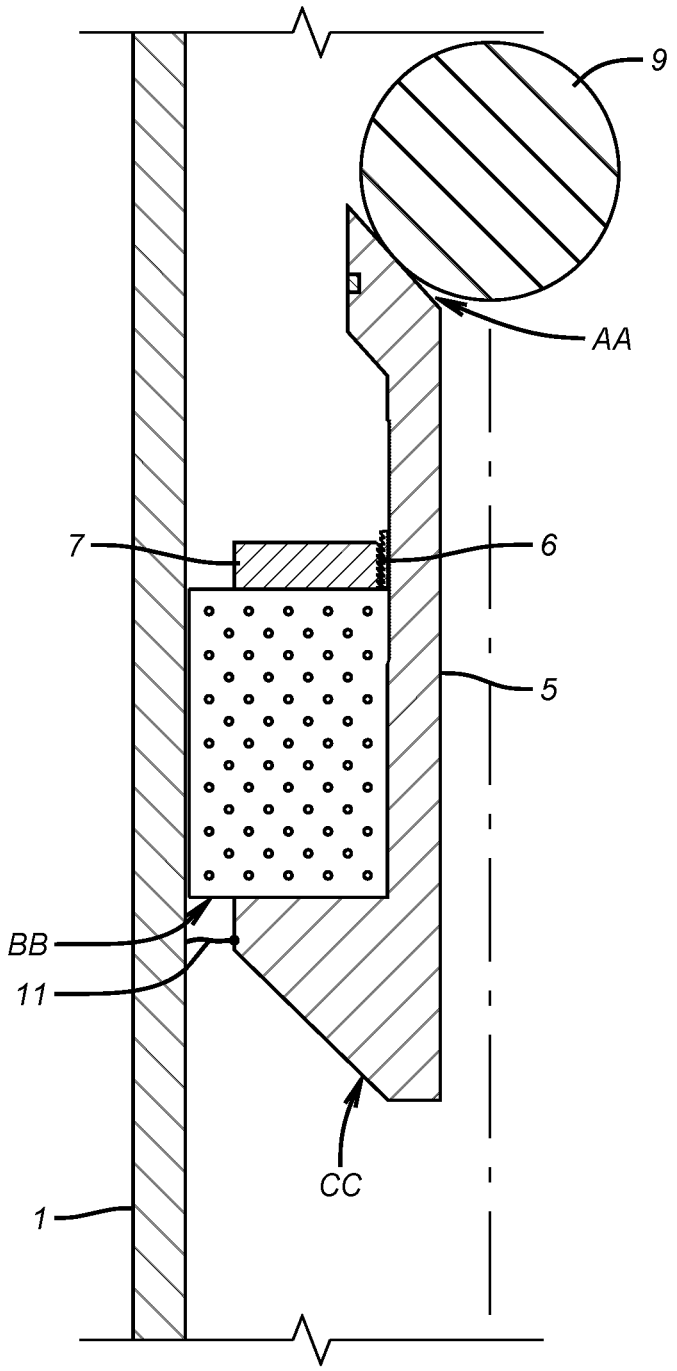
FIG. 4 is the view of FIG. 2 with a ball landed on a seat defined by a mandrel.

FIG. 1 schematically illustrates a casing or tubular 1 that defines a borehole in which the packer mandrel 5 is supported on a setting tool that is in turn supported by a wireline that is not shown. The setting tool can be a model E-4 sold by Baker Hughes Incorporated. Part 3 is held to mandrel 5 with a shear ring 4. The E-4 setting tool retains the mandrel 5 while moving the actuation sleeve 2 which results in axial movement of compression ring 7 to in turn compress the sealing element 8. As a result of the setting as shown in FIG. 2 part 3 is released from mandrel 5 as the shear ring is broken with piece 4*a* retained by part 3. The actuation sleeve 2 remains with the setting tool and comes out to the surface. This leaves the ball seat AA exposed for later acceptance of a ball 9 as shown in FIG. 4. A lock ring 6 holds the FIG. 2 set position of compression ring 7. The lower end of the plug mandrel 5 has a tapered nose CC that acts as a guide for running in. A small gap BB can be used to avoid extrusion of the element 8 in the FIG. 2 position or alternatively a flexible barrier schematically illustrated as 11 can be used. The barrier 11 can be retracted for running in and extended during the setting using a wedging action resulting from longitudinal compression of the element 8 to afford some protection to the barrier 11 when running in and to avoid slowing down the deployment speed of the plug P to the desired location. The sealing element 8 does not have to perfectly seal. It can be porous or impervious and needs to retain pressure differentials for a predetermined time which can be done with some leakage flow past the set element 8 or none.

Figure 3A:
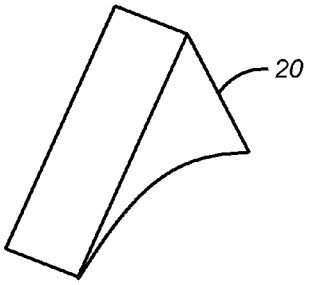
FIGS. 3*a*-3*c* are a perspective view of a wedge (3*a*) that is used to assemble an annular shape (3*b*) that is shown in a front view showing how the wedges are stacked (3*c*)
Figure 3B:
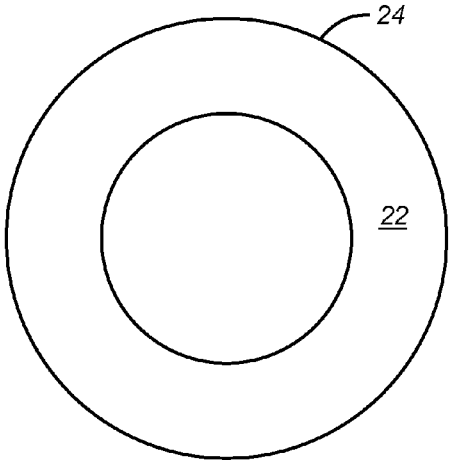
Figure 3C:
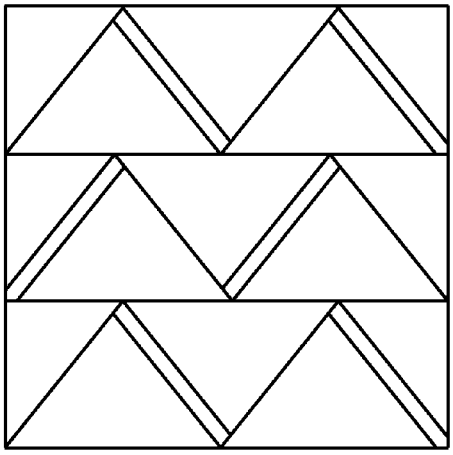

FIGS. 3*a*-3*c* show that the element can be formed from wedges 20 that can be stacked as shown in FIGS. 3*b* and 3*c* to make an annular shape 22 that can be supported by the mandrel 5 and axially crushed with movement of ring 7 to assume the FIG. 2 sealing position. The wedges 20 can be impermeable cellular concrete which is a combination of cementitious slurry with pre-formed foam meeting ASTM standard C869 and as is commercially available from the Geofill Cellular Concrete Company of Lincolnshire, IL, USA. The crushing of the annular shape 22 reconfigures the annular shape to a shorter length with a diameter that grows to reach the casing or tubular 1. The mandrel 5 is preferably made from CEM so that when it is time to remove the plug a disintegrating fluid can be introduced into the borehole to structurally fail the mandrel 5 as it is disintegrated or otherwise failed. With the structural support for the crushed annular shape removed it forms smaller pieces or simply loose granular shapes that are either removed from the location with circulation to the surface or allowed to move further downhole where they will either stay or be brought to the surface with subsequent production. An outer sheath 24 can be applied to the annular shape 22 so as to protect it during running in and to retain the crumbled element 8 until enough axial crushing force is applied to reshape the shape 22 to the set position in FIG. 2. The sheath 24 can be of a material that readily disappears with well fluid exposure or added materials or applied conditions in the well at a time before or during the setting action going from the FIG. 1 to the FIG. 2 position. The sheath 24 can optionally still be in the process of being removed as the element 8 is already set.

Other configurations for the element 8 is an agglomerated material that can be principally sand but can also have gravel, tempered glass, proppant, clay, Teflon® or rubber or a combination of the foregoing where the granular material can be held together with an adhesive or with cement. The materials used for the element 8 are designed in part to enhance its grip in the set position. The surrounding sheath 24 can be knitted Kevlar® or nylon or a disintegrating material and can be wrapped about the exterior of the element 8 or all the way around all surfaces of the element 8 or some degree of coverage in between. Alternatively, the sheath 24 can be disintegrated with well fluids, well temperatures or other intrinsic or applied well conditions to allow the element 8 to rapidly revert to loose granular form when the mandrel is undermined while at the same time providing protection during running in and cohesive structure to the element 8 as it is crushed and reformed for the sealing position in FIG. 2. Alternative ways to make the mandrel 5 fail is to use corrosion or melting from thermal exposure or a material that can disintegrate such as CEM.

Figure 5:
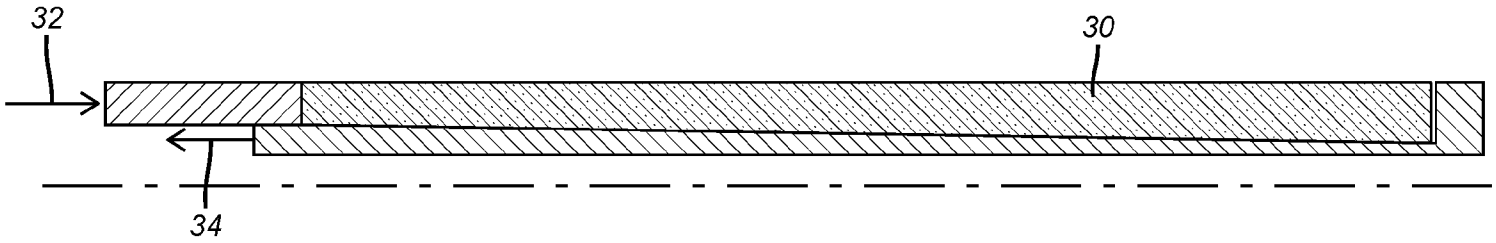
FIG. 5 is an alternative embodiment in a run in position where relative movement crushes a cellular cement sealing element.
Figure 6:
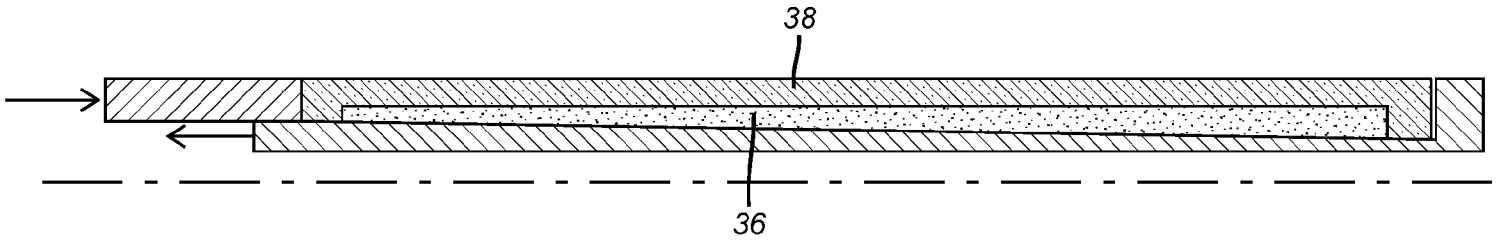
FIG. 6 is a variation of FIG. 5 where an inner layer of loose sand is located between a mandrel and the outer cellular cement exterior layer.

FIGS. 5 and 6 show the use of relative movement to directly axially crush an element 30 with arrows 32 and 34 representing the relative axial movement induced by a wireline setting tool or the like. In FIG. 5 the element 30 is preferably a cellular cement product alone and in FIG. 6 a layer of loose sand 36 is contained by the outer layer 38 that is preferably cellular cement.

Figure 7:
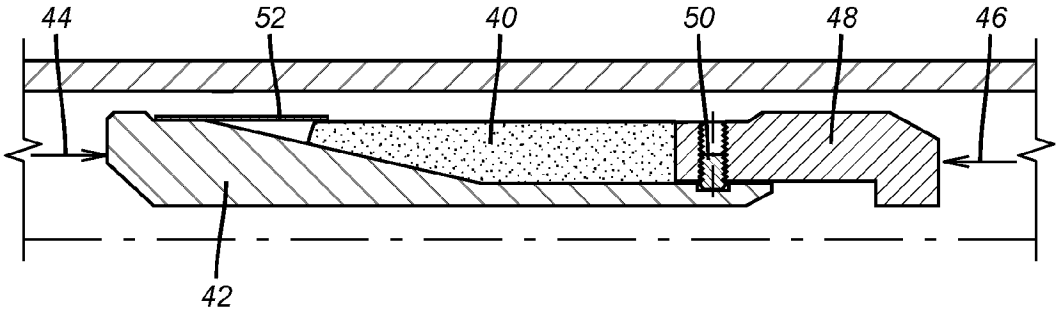
FIG. 7 is an alternative embodiment shown in half section in the run in position.
Figure 8:
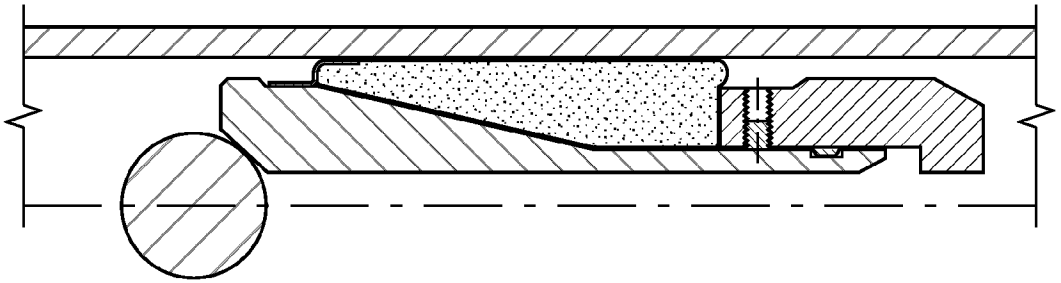
FIG. 8 is the view of FIG. 7 in the set position.

On the other hand, FIGS. 7 and 8 show the element 40 being pushed up a ramp 42 with opposed arrows 44 and 46 representing the opposed movement created by a setting tool which moves sleeve 48 to break shear pin 50. Element 40 is preferably a sand with Teflon® mix which is held together with glue, epoxy or cement with the binder selected to break down after a predetermined time due to thermal exposure so as to make the element 40 easier to reform from the FIG. 7 to the FIG. 8 set position while still leaving enough cohesiveness to allow the element 40 to be run in without an optional sheath 52. As before the sheath 52 can be over the exterior or can be all around the element 40 so that it contacts the ramp 42 which is preferably made of a disintegrating material such as CEM. The sheath can start disintegrating in temperatures as low as 200 degrees Fahrenheit.

Another way to extend the sealing element 8 is to radially expand the mandrel 5 in the location adjacent the sealing element 8.

The binder for the sand that comprises the bulk of the described elements above can be a polyurethane that is impregnated into the sand. Some of the particles in the mixture can store a material that is released on crushing of the element so as to act on the binder and break it down to facilitate ultimate removal of the plug as the mandrel disintegrates and the element reverts to loose granular material for relocation in the well or removal to the surface with circulation. The crushing during set can release chemicals or start a reaction that breaks the binder down and allows the mixture to return to a state of mostly granular sand for ultimate plug removal. The crushing of the element can also release an acid that starts to work on the mandrel that is preferably CEM so that by the time the fracking is done there is less time needed to ultimately fail the mandrel and make it disintegrate for displacement in the well or removal of any remnants to the surface. The ends of the mandrel can have interlocking components so that they do not relatively rotate in the event they need to be milled out for any reason. Another way to hold the granular material together is in a porous or impervious enclosure such as a mesh, a flexible film, a foam barrier that can optionally also be combined with binder for the granular material that is preferably sand. The enclosure or cover can be degraded as can the granular binder using the same or different agents that are either introduced in the borehole, already present in the borehole or stored in the granular material for a release on setting or before or after the set position for the sealing element is obtained. Some sharp and hard particles can also be used for the multiple purposes of enhancing grip in the set position as the granular material is dewatered from being compacted with a potential added benefit of starting to undermine the covering physically as the set position is obtained. Such particles can be rubber, CEM chips, swelling rubber or deformable synthetic sand. The cover can then be more fully removed with other means such as thermal exposure, chemical exposure or simply mechanical damage from compaction of the element that such a cover surrounds.

The above description is illustrative of the preferred embodiment and many modifications may be made by those skilled in the art without departing from the invention whose scope is to be determined from the literal and equivalent scope of the claims below:

We claim:

1. A removable plug for subterranean use, comprising:

a mandrel made of a mandrel material that can be structurally compromised after a predetermined time with exposure to existing well conditions upon running in or later created well conditions;

a sealing element comprising at least one granular material external to and in direct contact with said mandrel for a run in and a set position created by an actuation assembly in direct contact with said at least one granular material that defines the shape of said sealing element said actuation assembly remaining clear of a borehole wall while selectively axially crushing said sealing element against the borehole wall or crushing said sealing element axially while forcing said at least one granular material radially along a ramp to contact a surrounding borehole wall for resisting applied differential pressure in said set position;

whereupon setting said sealing element in said set position and application of said differential pressure, exposure of said mandrel to existing or subsequent well conditions causes said structural compromise of said mandrel to allow said granular sealing element material to disperse so that the plug is removed from a subterranean location.

2. The plug of claim 1, wherein:

said sealing element granular material is retained with a binder.

3. The plug of claim 2, wherein:

said binder is compromised when said sealing element is in said set position.

4. The plug of claim 2, wherein:

said binder is compromised with a substance released from within said sealing element.

5. The plug of claim 4, wherein:

said sealing element contains an encapsulated chemical that is released when said sealing element is axially compressed to said set position.

6. The plug of claim 1, wherein:

said sealing element granular material is formed into multiple initial unit shapes defining gaps;

said unit shapes are broken when said sealing element is in said set position.

7. The plug of claim 6, wherein:

a plurality of unit shapes are stackable to form an initial annular shape defining gaps;

said annular shape is reconfigured by breakage of said unit shapes into a shorter axial length and a greater diameter for said set position of said sealing element.

8. The plug of claim 1, wherein:

said sealing element is formed principally of principally natural or synthetic sand but can also comprise at least some gravel, tempered glass, proppant, clay, Teflon®, swelling rubber or rubber or a combination thereof.

9. The plug of claim 1, further comprising:

a cover over at least an exterior face of said sealing element and configured to begin failing with exposure to existing well conditions upon running in or later created well conditions;

wherein failing of said cover allows said material, which is granular, to disperse after a time of applied differential pressure against said plug so that the plug is removed from a subterranean location without further mechanical intervention at the subterranean location.

10. The plug of claim 9, wherein:

said cover is over at least an exterior face of said sealing element.

11. The plug of claim 1, wherein:

said mandrel is made from a material that disintegrates when exposed to existing or created conditions at the subterranean location.

12. The plug of claim 11, wherein:

said mandrel is made from at least one controlled electrolytic material which is undermined by chemicals found at the subterranean location or added to the subterranean location from a surface or released from said sealing element being put into a set position.

13. The plug of claim 1, wherein:
said sealing element comprises natural or synthetic sand held together by a binder that is selectively undermined when said sealing element is put into said set position.
14. The plug of claim 1, wherein:
said mandrel comprises a through passage surrounded by a seat to accept an object that lands on said seat after said sealing element is in said set position.
15. The plug of claim 1, wherein:
said sealing element is porous.
16. The plug of claim 1, wherein:
said sealing element allows some or no leakage when set.
17. The plug of claim 1, wherein:
said granular sealing element material grips in said set position.
18. The plug of claim 1, wherein:
said sealing element is pushed radially with expansion of said mandrel.
19. The plug of claim 1, wherein:
said sealing element is impervious.
20. A removable plug for subterranean use, comprising:
a mandrel made of a material that can be structurally compromised after a predetermined time with exposure to existing well conditions upon running in or later created well conditions;
a granular sealing element externally mounted to said mandrel for a run in and a set position created by an actuation assembly that selectively axially compacts said sealing element or pushes the sealing element radially to contact a surrounding borehole wall;
said sealing element essentially comprising at least one material, such that upon setting said sealing element in said set position said structural compromise of said mandrel allows said sealing element material to disperse after a time of applied differential pressure against said plug so that the plug is removed from a subterranean location;
said sealing element comprises pellets that encapsulate a chemical for release when said sealing element is placed in said set position;
said chemical undermines at least one of a binder for said granular sealing element, and said mandrel.
21. A removable plug for subterranean use, comprising:
a mandrel made of a material that can be structurally compromised after a predetermined time with exposure to existing well conditions upon running in or later created well conditions;
a sealing element externally mounted to said mandrel for a run in and a set position created by an actuation assembly that selectively axially compacts said sealing element or pushes the sealing element radially to contact a surrounding borehole wall;
said sealing element essentially comprising at least one material, such that upon setting said sealing element in said set position to a set position length and application of differential pressure against said plug while said sealing element maintains said set position length, said structural compromise of said mandrel from exposure to existing or subsequent well conditions allows said sealing element to disperse so that the plug is removed from a subterranean location;
a cover over an exterior face of said sealing element and configured to begin failing with exposure to existing well conditions upon running in or later created well conditions;
wherein failing of said cover allows said sealing element material, which is granular, to disperse after a time of applied differential pressure against said plug as said sealing element material maintains a length associated with the set position so that the plug is removed from a set subterranean location;
said cover fully surrounds said sealing element.
22. The plug of claim 21, wherein:
said cover is porous.
23. The plug of claim 21, wherein:
said cover comprises knitted Kevlar® or nylon.
24. The plug of claim 21, wherein:
said cover is undermined by said sealing element when put into said set position.
25. The plug of claim 24, wherein:
said sealing element contains particles that tear said cover.
26. A removable plug for subterranean use, comprising:
a mandrel made of a material that can be structurally compromised after a predetermined time with exposure to existing well conditions upon running in or later created well conditions;
a sealing element externally mounted to said mandrel for a run in and a set position created by an actuation assembly that selectively axially compacts said sealing element or pushes the sealing element radially to contact a surrounding borehole wall;
said sealing element essentially comprising at least one material held with a binder, such that upon setting said sealing element in said set position said structural compromise of said mandrel allows said sealing element material to disperse after a time of applied differential pressure against said plug so that the plug is removed from a set subterranean location;
said sealing element contains a chemical that is released to defeat the binder or structurally compromise said mandrel.
27. A completion method for subterranean use, comprising:
setting a barrier against a surrounding borehole wall, said barrier comprising
at least one mandrel made of a mandrel material that can be structurally compromised after a predetermined time with exposure to existing well conditions upon running in or later created well conditions;
a sealing element comprising at least one granular material external to and in direct contact with said mandrel for a run in and a set position created by an actuation assembly in direct contact with said at least one granular material that defines the shape of said sealing element;
keeping said actuation assembly clear of a borehole wall while selectively axially crushing said sealing element against the borehole wall or while axially crushing said sealing element and forcing said at least one granular material radially along a ramp to contact a surrounding borehole wall;
performing a completion operation against said sealing element in said set position;
initiating structural compromise of said mandrel to allow said at least one granular material to disperse after said performing so that the plug is removed from a subterranean location.
28. The method of claim 27, comprising:
fracturing a formation during said completion operation.
29. The method of claim 27, comprising:
retaining said granular material with a binder.

30. The method of claim 29, comprising:

compromising said binder when said sealing element is in said set position.

31. The method of claim 29, comprising:

compromising said binder with a substance released from within said sealing element.

32. The method of claim 31, comprising:

providing an encapsulated chemical in said sealing element that is released when said sealing element is axially compressed to said set position.

33. The method of claim 27, comprising:

forming said granular material into a plurality of initial unit shapes defining gaps;

breaking said unit shapes when said sealing element is in said set position.

34. The method of claim 33, comprising:

stacking said plurality of unit shapes to form an initial annular shape;

reconfiguring said annular shape by breakage of said unit shapes into a shorter axial length and a greater diameter for said set position of said sealing element.

35. The method of claim 27, comprising:

forming said sealing element principally of principally natural or synthetic sand but can also comprise at least some gravel, tempered glass, proppant, clay, Teflon®, swelling rubber or rubber or a combination thereof.

36. A removable plug for subterranean use, comprising:

a mandrel made of a mandrel material that can be structurally compromised after a predetermined time with exposure to existing well conditions upon running in or later created well conditions;

an anchor element comprising at least one granular material external to and in direct contact with said mandrel for a run in and a set position created by an actuation assembly in direct contact with said at least one granular material that defines the shape of said anchor element said actuation assembly remaining clear of a borehole wall while selectively axially crushing said anchor element against the borehole wall or crushing said anchor element axially while forcing said at least one granular material radially along a ramp to contact a surrounding borehole wall;

said anchor element resisting applied differential pressure thereto;

whereupon setting said anchor element in said set position said structural compromise of said mandrel allows said at least one granular material of said anchor element to disperse after a time of applied differential pressure against said plug so that the plug is removed from a subterranean location.

37. The plug of claim 36, wherein:

said anchor element at least partially seals to the borehole wall.

38. The plug of claim 37, wherein:

said anchor element fully seals to the borehole wall.

39. A removable plug for subterranean use, comprising:

a mandrel made of a material that can be structurally compromised after a predetermined time with exposure to existing well conditions upon running in or later created well conditions;

a sealing element externally mounted to said mandrel for a run in and a set position created by an actuation assembly that selectively axially compacts said sealing element or pushes the sealing element radially to contact a surrounding borehole wall;

said sealing element essentially comprising at least one material, such that upon setting said sealing element in said set position said structural compromise of said mandrel allows said material to disperse after a time of applied differential pressure against said plug so that the plug is removed from a set subterranean location against the surrounding borehole wall without further mechanical intervention at the subterranean location;

a cover over at least an exterior face of said sealing element and configured to begin failing with exposure to existing well conditions upon running in or later created well conditions;

wherein failing of said cover allows said material, which is granular, to disperse after a time of applied differential pressure against said plug so that the plug is removed from a subterranean location;

said cover is impervious.

* * * * *